United States Patent [19]

Schweimanns et al.

[11] 3,994,702

[45] Nov. 30, 1976

[54] METHOD OF DISCHARGING RESIDUES FROM A PRESSURIZED GASIFICATION CHAMBER

[75] Inventors: Hans-Reiner Schweimanns, Niederwenigern; Karl-Heinz Dutz, Herten, both of Germany

[73] Assignee: Shell International Research Maatschappij B.V., The Hague, Netherlands

[22] Filed: Nov. 20, 1975

[21] Appl. No.: 633,655

[30] Foreign Application Priority Data

Nov. 21, 1974 Germany ..... 2455127

[52] U.S. Cl. ..... 48/197 R; 48/206; 110/165 R; 110/171; 210/73 R; 210/83; 214/17 B; 261/72 R; 261/74; 302/14

[51] Int. Cl.[2] ..... C10J 3/52

[58] Field of Search ..... 48/197 R, 206, 210, 48/DIG. 7, 69; 110/165 R, 171; 210/73 R, 83, 84; 214/17 B; 261/72 R, 74; 302/53, 59, 14

[56] References Cited

UNITED STATES PATENTS

| | | | |
|---|---|---|---|
| 2,919,240 | 12/1959 | Degnen | 302/53 |
| 2,985,324 | 5/1961 | Balentine | 214/17 B |
| 3,544,291 | 4/1968 | Schlinger et al. | 48/206 |

*Primary Examiner*—Robert L. Lindsay, Jr.
*Assistant Examiner*—George C. Yeung
*Attorney, Agent, or Firm*—Michael J. Striker

[57] ABSTRACT

A method of discharging residues resulting from gasification of fuel in a chamber filled in a lower portion thereof with water and having a gas cushion at high pressure above the water level, in which the residues accumulating in the chamber are discharged through a sluicing container connected to the lower end of the chamber and conveyor means connected to the sluicing chamber.

11 Claims, 3 Drawing Figures

METHOD OF DISCHARGING RESIDUES FROM A PRESSURIZED GASIFICATION CHAMBER

BACKGROUND OF THE INVENTION

The present invention relates to a method of discharging residues, resulting from gasification of fuel in a chamber filled at the lower portion thereof with water and having a gas cushion at high pressure above the level of water, from this chamber through a water filled sluicing container having an upper end located beneath and fluid tightly connectable with and disconnectable from the lower end of the chamber, into a conveyor connected to the lower end of the sluicing container.

During operation of such a sluicing arrangement it is of utmost importance to prevent during discharge of residues from the gasification chamber simultaneous discharge of gas produced in the chamber through the sluicing system, as well as entrance of air from the atmosphere into the gasification chamber. While systems are known in the art to prevent such occurrence, these known systems have not proven 100% satisfactory.

SUMMARY OF THE INVENTION

It is an object of the present invention to provide a method of discharging heavy residues, resulting from gasification of fuel in a chamber filled at the lower portion thereof with water and having a gas cushion at high pressure above the level of water therein, from this chamber through a sluicing system which is improved over sluicing systems known in the art.

It is a further object of the present invention to provide a method of the aforementioned kind in which during discharge of residues from the gasification chamber entrance of air into the latter or discharge of gas produced therein through the sluicing system is positively avoided.

With these and other objects in view, which will become apparent as the description proceeds, the method according to the present invention of discharging heavy residues, resulting from gasification of fuel in a chamber filled at the lower portion thereof with water and having a gas cushion at high pressure above the level of water, from the chamber through a water filled sluicing container having an upper end located beneath and fluid tightly connectable to and disconnectable from the lower end of the chamber, into conveyor means, mainly comprises the steps of connecting the sluicing container to the lower end of the chamber and discharging residues accumulated in the latter by gravity from the chamber into the sluicing container, providing a pressure equalizer permanently connected to the upper end of the sluicing container and maintaining, during discharge of residues from the chamber, in the pressure equalizer water at the same level as in the chamber and above the water level a cushion of neutral gas of the same pressure as the gas cushion in the chamber, interrupting the connection between the chamber and the sluicing container while reducing the pressure of the cushion of neutral gas in the pressure equalizer, connecting the lower end of the sluicing container with the conveyor means and discharging water and residue accumulated in the sluicing container from the latter into the conveyor means while simultaneously feeding a neutral gas at low pressure into the pressure equalizer, interrupting, after substantially emptying the sluicing container, the connection between the latter and the conveyor means and refilling the sluicing container and the pressure equalizer with water; and subsequently reestablishing the connection between the chamber and the sluicing container while feeding neutral gas under higher pressure than that in the chamber into the pressure equalizer to bring the pressure in the sluicing system, comprising the pressure equalizer and the sluicing container, again up to the pressure prevailing in the chamber.

The neutral or inert gas for the pressure equalizer is preferably nitrogen which is obtained during production of oxygen used for partial combustion of the fuel in the gasification chamber to produce a combustible gas therein.

The pressure equalizer used according to the present invention can be constructed with relatively small dimensions and accordingly the amount of neutral gas to be discharged therefrom during release of pressure from the sluicing system, including the sluicing container and the pressure equalizer, will be relatively small. This neutral gas may therefore be discharged downwardly through a water filled open ended container into the atmosphere, or the discharged neutral gas may be recovered by discharging the same into a neutral gas container maintained at low pressure.

Instead of refilling the sluicing system, comprising the sluicing container and the pressure equalizer, after discharge of residues from the sluicing container, with water under low pressure and only thereafter reestablishing in the sluicing system the same pressure as prevails in the gasification chamber by feeding neutral gas under the corresponding pressure into the pressure equalizer, it is also possible to refill the sluicing system with water from the water bath maintained in the gasification chamber or from conduits feeding water into and out from the water bath maintained in the gasification chamber, whereby before refilling of the sluicing system with pressurized water the sluicing system is filled from a pressurized container with neutral gas which, during refilling of the sluicing system with water under pressure, is partly pushed back into the pressurized gas container. In this way the pressure difference between the gasification chamber and the sluicing system during the refilling step of the latter will be held relatively small so that the stresses imparted to a valve in the connection between the lower end of the gasification chamber and the upper end of the sluicing container will, likewise, be relatively small.

The residues discharged from the sluicing container into the conveyor means are hydraulically transported in the latter, whereby the necessary pressurized water may be circulated by a pump through an endless conduit provided with a collecting container for the residues, or may be taken from the water bath maintained in the lower portion of the gasification chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
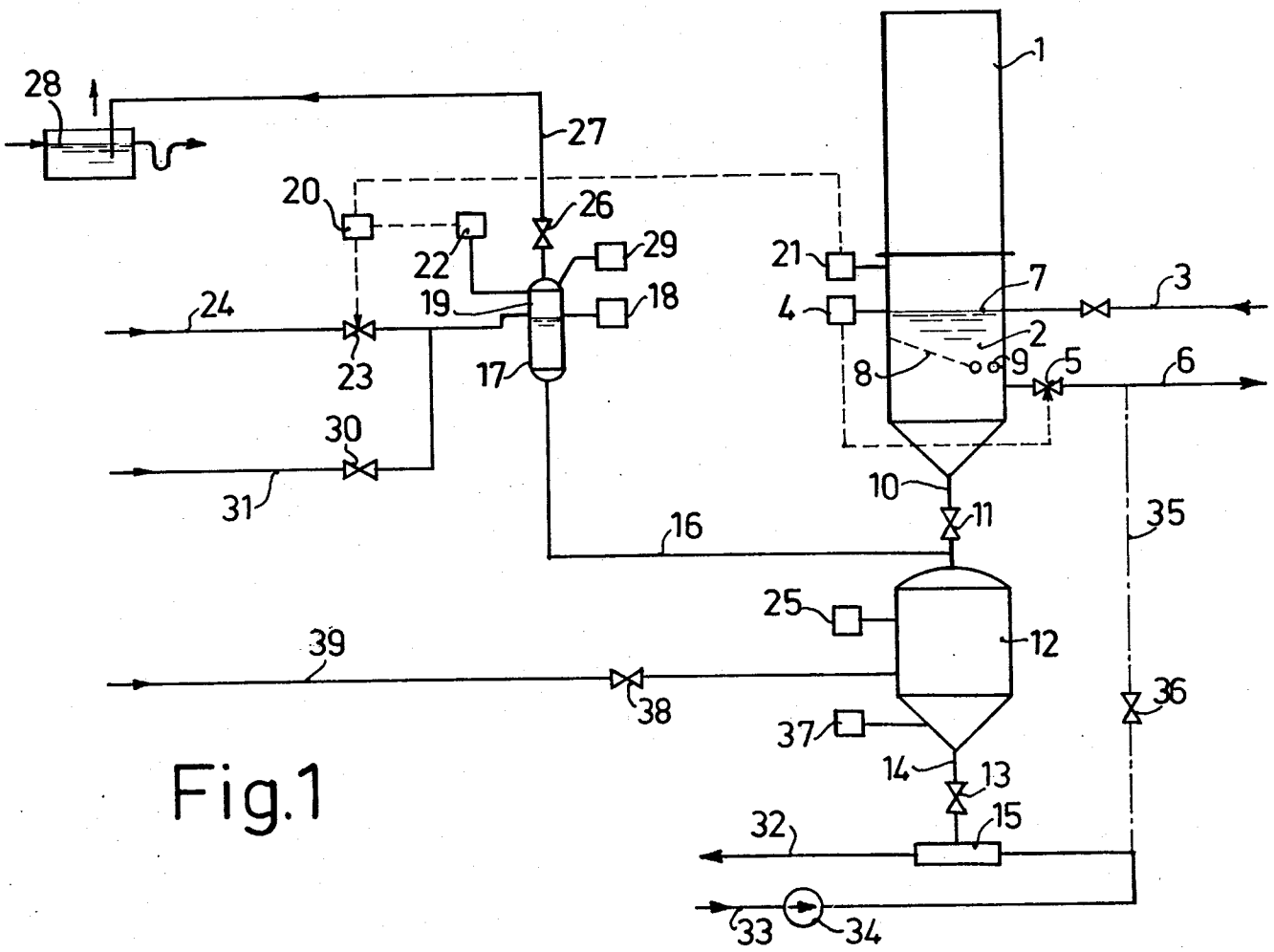
FIG. 1 schematically illustrates an arrangement for carrying out the method according to the present invention.

Referring now to the drawing, and more specifically to FIG. 1 of the same, it will be seen that the arrangement for carrying out the method according to the present invention may comprise a gasification chamber 1 in which, in a manner known per se, a combustible gas is continously produced by partially combusting fuel, especially pulverized coal, with oxygen-containing gases (air, air enriched with oxygen or nearly pure oxygen) to obtain a gas which substantially consists of $H^2$, CO and $CO_2$. The nozzles and conduits for feeding the fuel and the oxygen-containing gas into the gasification chamber 1 and for discharging the gas produced therein are omitted, for simplification reasons, from the drawing. The gas is continuously produced and continuously discharged from the gasification chamber whereby in the latter a pressure of about 30 atmospheres is maintained. A water bath 2 is maintained in the lower portion of the gasification chamber 1 and water under pressure is fed through a conduit 3 into the water bath 2 while control means 4, communicating with the interior of the gasification chamber at the desired level 7 of the water bath to be maintained therein, are connected to a valve 5 in a conduit 6 to control discharge of water through the conduit 6 from the water bath 2 so as to maintain the water bath at the desired level 7. The residues resulting from the partial combustion of the fuel, that is mostly ash resulting from the combustion of the particulate coal will granulate in the water bath and cool therein. Residues of small dimensions will fall through a grate 8 in the water bath 2 whereas pieces of ash of larger dimension are crushed by a crusher 9 of known construction, only schematically illustrated in FIG. 1, and provided at the lower end of the inclined grate. The residues accumulating at the bottom of the water bath are discharged therefrom by gravity through a conduit 10 connecting the lower end of the gasification chamber with the upper end of a sluicing container 12 located beneath the gasification chamber. During this discharge of residues from the gasification chamber 1 into the sluicing container 12, the valve 11 provided in the conduit 10 is maintained open, whereas a valve 13 in a conduit 14 connecting the lower end of the sluicing container 12 with conveyor means 15 located below the sluicing container 12, is closed.

The sluicing container 12 is connected with a pressure equalization container 17 of relatively small diameter through a conduit 16 which communicates with the conduit 10 downstream of the valve 11 provided therein. A level sensor 18 communicates with the interior of the pressure equalization container 17 to maintain therein, as will be explained later on, a water bath at the same level as the water bath 2 in the gasification chamber 1, while above the water bath in the container 17 a cushion 19 of neutral gas, preferably nitrogen, is maintained at the same pressure as is prevailing in the gasification chamber 1. This is obtained, as will be explained later on in further detail, by means of a pressure indicator 22 communicating with the upper end of the container 17, a corresponding pressure indicator 21 communicating with the interior of the gasificiation chamber above the level of water therein and a pressure regulator 20 connected to the pressure indicators 21 and 22 and controlling feeding of nitrogen under pressure into the pressure equalization container 17.

When the sluicing container 12 is filled up to a predetermined level, sensed by a sensor 25, with residues from the gasification chamber 1, the valve 11 in the conduit 10 is closed, the pressure regulator 20 is deactivated and the valve 23 in a conduit 24 feeding nitrogen under pressure into the container 17 is likewise closed. Subsequently, a valve 26 in a gas discharge conduit 27 communicating with the upper end of the pressure equalization container 17 is opened so that the sluicing system, comprising the sluicing container 12 and the pressure equalization container 17, is placed under atmospheric pressure. The nitrogen thereby discharged from the pressure equalization container 17 escapes through the conduit 27 and passes downwardly through a water bath in an open ended container 28 into the atmosphere, whereby entrance of air from the atmosphere into the conduit 27 is prevented. As soon as a predetermined minimum pressure, measured by the manometer 29 communicating with the upper end of the pressure equalization container 17, is reached, a valve 30 in a conduit 31 connected at one end, not shown in the drawing, with a source of nitrogen at low pressure, for instance 200 millimeter water column, is opened so that the sluicing system, comprising the containers 17 and 12, is now maintained at the aforementioned pressure of about 200 millimeters water column. Subsequently, the valve 13 in the conduit 14 is opened so that the residues are discharged through the conduit 14 into the conveyor means 15.

The conveyor means 15 is hydraulically operated. A mixture of pressurized water and residues is transported from the conveyor means 15 through a conduit 32 to a non-illustrated collecting container for the residues, from which the water is discharged, passed through a conduit 33 and a pump 34 and, with the necessary pressure, again recirculated through the conveyor means. Instead of continuously recirculating the pressurized water in a closed circuit it is possible to convey the pressurized water through a conduit 35 which has a valve 36 located therein and which communicates with the conduit 6 for discharging water from the water bath 2, as indicated in dashed-dotted lines in FIG. 1.

After the residues have been discharged from the sluicing container 12 up to a predetermined minimum level, established by a sensor 37 communicating with a lower portion of the sluicing container 12, the valves 13 and 30 are closed. Subsequently, a valve 38 in a conduit 39 communicating at one end with the sluicing container 12 and at its other end with a source of water (not shown) under low pressure, for instance 3 atmospheres overpressure, is opened to thereby feed water at the aforementioned pressure into the sluicing system until the water level in the pressure equalization container 17, which is controlled by the level indicator 18, reaches the same level as the water bath 2. Subsequently, the valve 26 in the pressure release conduit 27 is closed and the valve 23 in the conduit 24, supplied with nitrogen under pressure higher than the pressure prevailing in the gasification chamber 1, is opened thereby subjecting the small cushion of nitrogen 19 in the container 17 to the pressure prevailing in the conduit 24. After a predetermined maximum pressure, that is the same pressure as is maintained above the water bath 2 in the gasification chamber 1 is sensed by the manometer 29, the valve 11 is opened, preferably automatically by operating the valve 11 in a known manner through signals from the manometer 29, while the valve 23 is closed so that the sluicing container is again connected with the lower end of the gasification chamber and the water bath 2 maintained therein. The residues which have in the meantime accumulated in the water bath 2 are now again discharged into the sluicing container 12 and the aforementioned cycle repeated.

Figure 1A:
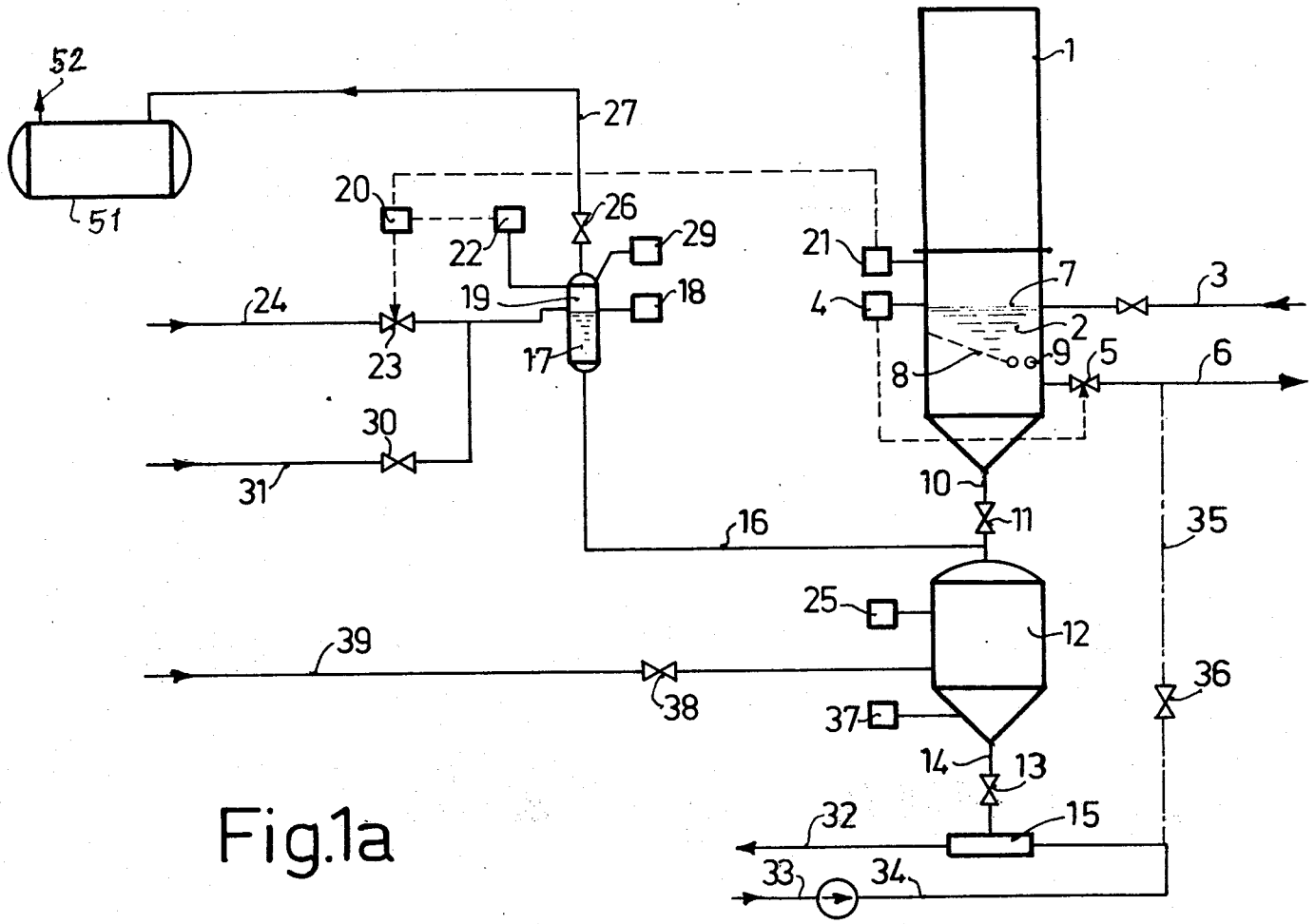
FIG. 1*a* schematically illustrates a slight modification of the arrangement shown in FIG. 1.

The arrangement illustrated in FIG. 1*a*is substantially identical with the above-described arrangement illustrated in FIG. 1, the only difference being that the pressure release conduit 27 communicates at its end distant from the container 17 with a neutral gas collecting container 51 from which the neutral gas may be discharged through a conduit 52 to be reused by compressing the same and feeding it into the conduit 24 or, at relatively low pressure, into the conduit 31.

Figure 2:
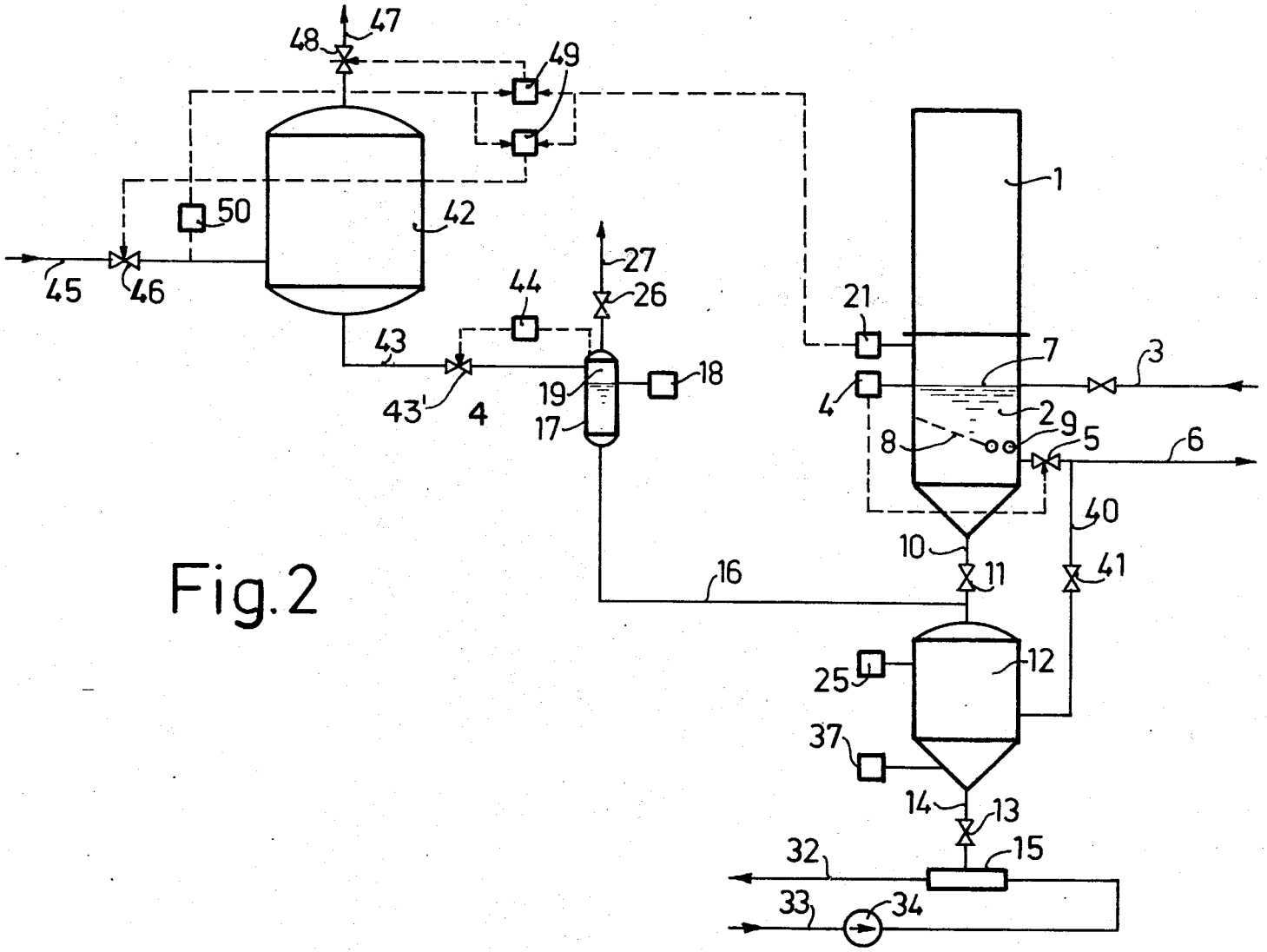
FIG. 2 schematically illustrates a further arrangement for carrying out the method.

A further modification of an arrangement for carrying out the method according to the present invention is illustrated in FIG. 2. Such portions of the arrangement shown in FIG. 2 which are identical with those illustrated in FIG. 1 are designated in FIG. 2 with the same reference numerals as in FIG. 1. In the arrangement as shown in FIG. 2, the sluicing system, comprising the containers 12 and 17, is not refilled with water at low pressure after discharge of the residues therefrom, as in the arrangement shown in FIG. 1, but the sluicing system is refilled with water through a conduit 40 provided with a valve 41 therein, which conduit 40 branches off from the conduit 6 serving to discharge water from the water bath 2 maintained in the lower portion of the gasification chamber 1. In order to maintain a small pressure difference at the valve 41, nitrogen at high pressure is fed into the sluicing system before the sluicing system is refilled with water. The necessary nitrogen under pressure is thereby fed through a conduit 43, from a pressure container 42 filled with nitrogen under pressure into the container 17. The pressure container 42 is supplied with nitrogen under pressure from a source, not shown in the drawing, through a conduit 45 in which a valve 46 is provided, whereas a conduit 47 with a valve 48 provided therein communicates with the interior of the pressure container 42 for discharging nitrogen therefrom. The valves 46 and 48 are operatively connected to control means 49 which in turn are connected to the pressure sensor or pressure indicating means 21 communicating with the gasification chamber 1 above the water level therein and with a pressure sensor 50 communicating with the conduit 45 downstream of the valve 46 therein, to maintain the nitrogen in the pressure container 42 at a pressure substantially equal to or slightly greater than the pressure prevailing in the gasification chamber 1 above the water bath therein. Since in the arrangement shown in FIG. 2 no conduit 31 for feeding nitrogen under low pressure into the pressure equalization container 17 is provided, the arrangement shown in FIG. 2 comprises a valve 43′ in the conduit 43 connecting the pressure container 42 with the pressure equalization container 17, and this valve 43′ is operatively connected to a pressure regulator 44 sensing the pressure in the nitrogen cushion 19 in the container 17 and adjusting the opening of the valve 43′ during opening of the valve 13 and discharge of residues from the sluicing container 12 to throttle the nitrogen passing through the conduit 43 in such a manner that during discharge of residues from the container 12 a pressure of about 200 millimeters water column is maintained in the nitrogen cushion 19 of the pressure equalization container 17. After discharge of the residues from the container 12 and closing of the valve 13 the pressure regulator 44 is deactivated and the valve 43′ in the conduit 43 is fully opened so that the sluicing system, comprising the containers 12 and 19, is subjected to the full pressure maintained in the pressure container 42. Only subsequently thereto is the sluicing system refilled with pressurized water, whereby the nitrogen is pressed back into the pressure container 42, avoiding thereby any loss of nitrogen.

It will be understood that each of the elements described above, or two or more together, may also find a useful application in other types of methods for discharging residues from a gasification chamber differing from the types described above.

While the invention has been illustrated and described as embodied in a method of discharging residues resulting from gasification of fuel in a gasification chamber through a sluicing system, it is not intended to be limited to the details shown, since various modification and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of discharging heavy residues, resulting from gasification of coal or solid carbonaceous fuel in a gasification chamber filled at the lower portion thereof with water and having a gas cushion at high pressure above the level of water, from the chamber through a water-filled sluicing container having an upper end located beneath and water-tightly connectable to and disconnectable from the chamber into conveyor means, comprising the steps of connecting said sluicing container to the lower end of said chamber and discharging residues by gravity from said chamber into said sluicing container; providing a pressure equalizer permanently connected to the upper end of said sluicing container and maintaining, during discharge of residues from said chamber, in said pressure equalizer water at the same level as in said chamber and above the water level a cushion of neutral gas of the same pressure as the gas cushion in the chamber; interrupting the connection between said chamber and said sluicing container while reducing the pressure of said cushion of neutral gas in said pressure equalizer; connecting the lower end of the sluicing container with said conveyor means while feeding simultaneously a neutral gas at low pressure into said pressure equalizer; interrupting, after emptying said sluicing container to a predetermined degree, the connection between the latter and said conveyor means and refilling said sluicing container and said pressure equalizer with water; and subsequently reestablishing the connection between said chamber and said sluicing container while feeding neutral gas under higher pressure than that in said chamber into said pressure equalizer to bring the pressure in the sluicing system, comprising the pressure equalizer and the sluicing container, again up to the pressure prevailing in the chamber.

2. A method as defined in claim 1, wherein said step of reducing the pressure in said pressure equalizer comprises the step of discharging neutral gas therefrom into the atmosphere.

3. A method as defined in claim 2, wherein said neutral gas is discharged downwardly into water in a container having an upper open end.

4. A method as defined in claim 1, wherein the step of reducing the pressure in said pressure equalizer comprises the step of discharging neutral gas therefrom into a neutral gas container.

5. A method as defined in claim 1, wherein the step of refilling the sluicing container and the pressure equalizer with water, after emptying the sluicing container to a predetermined degree, comprises the step of discharging water from said chamber into said sluicing container.

6. A method as defined in claim 5, wherein said pressure equalizer and said sluicing container are filled with a neutral gas under pressure from a pressure vessel before said sluicing container and said pressure equalizer are refilled with water, whereby the neutral gas is pushed partly back into the pressure vessel during the water refilling step.

7. A method as defined in claim 1, and including the steps of providing conduits for feeding water into and out of said chamber and sensing the level of water in said chamber to maintain a predetermined level of water therein, and wherein said step of refilling the sluicing container and the pressure equalizer with water comprises the step of feeding water from one of said conduits into the sluicing container.

8. A method as defined in claim 7, wherein said pressure equalizer and said sluicing container are filled with a neutral gas under pressure from a pressure vessel before the sluicing container and the pressure equalizer are refilled with water, whereby the neutral gas is pushed partly back into the pressure vessel during the water refilling step.

9. A method as defined in claim 1, wherein the residues are hydraulically transported in the conveyor means.

10. A method as defined in claim 9, and including the step of circulating water by a pump through the conveyor means to transport the residues from the sluicing container to a collecting container.

11. A method as defined in claim 9, wherein water under pressure for operating the conveyor means is taken from the water in the chamber.

* * * * *